United States Patent [19]

Hiraoka et al.

[11] 4,409,294

[45] Oct. 11, 1983

[54] SLIDING MEMBER FOR USE IN AN INTERNAL COMBUSTION ENGINE

[75] Inventors: Takeshi Hiraoka, Ageo; Yoshikatsu Nakamura, Omiya; Osamu Kawamura, Urawa, all of Japan

[73] Assignee: Nippon Piston Ring Co., Ltd., Tokyo, Japan

[21] Appl. No.: 265,927

[22] Filed: May 21, 1981

[30] Foreign Application Priority Data

May 29, 1980 [JP] Japan ..... 55/70831

[51] Int. Cl.[3] ..... B22F 9/00

[52] U.S. Cl. ..... 428/553; 428/682; 428/937

[58] Field of Search ..... 428/553, 937, 682, 683; 427/34, 225, 436; 75/208 R, 243, 246, 230, 126 R, 126 A; 29/DIG. 39, 156.7 A; 419/9

[56] References Cited

U.S. PATENT DOCUMENTS

| | | | |
|---|---|---|---|
| 3,283,117 | 11/1966 | Holmes | 427/34 |
| 3,837,894 | 9/1974 | Tucker | 427/34 |
| 3,900,936 | 8/1975 | Hill | 75/243 |
| 3,918,134 | 11/1975 | Telang | 427/34 |
| 3,938,814 | 2/1976 | Cromwell | 428/937 |
| 4,021,205 | 5/1977 | Matsuda | 75/246 |
| 4,035,159 | 7/1977 | Hashimoto | 75/246 |
| 4,080,209 | 3/1978 | Niimi | 75/246 |
| 4,101,713 | 7/1978 | Hirsch | 428/937 |
| 4,117,179 | 9/1978 | Jackson | 427/34 |
| 4,202,691 | 5/1980 | Yurasko | 428/937 |
| 4,204,031 | 5/1980 | Takamura | 75/246 |
| 4,230,491 | 10/1980 | Behnke | 75/243 |
| 4,275,124 | 6/1981 | McComas | 427/34 |

FOREIGN PATENT DOCUMENTS

| | | | |
|---|---|---|---|
| 2438923 | 11/1975 | Fed. Rep. of Germany | 427/34 |
| 47-22309 | 10/1972 | Japan | 75/243 |
| 50-90509 | 7/1975 | Japan | 75/243 |
| 52-23512 | 2/1977 | Japan | 75/230 |
| 54-29174 | 9/1979 | Japan | 75/243 |
| 55-44556 | 3/1980 | Japan | 75/243 |
| 55-145157 | 11/1980 | Japan | 75/243 |
| 56-5968 | 1/1981 | Japan | 427/34 |
| 56-5969 | 1/1981 | Japan | 427/34 |
| 56-8904 | 2/1981 | Japan | 75/246 |

*Primary Examiner*—L. Dewayne Rutledge
*Assistant Examiner*—J. J. Zimmerman
*Attorney, Agent, or Firm*—Sughrue, Mion, Zinn, Macpeak and Seas

[57] ABSTRACT

A sliding member for use in an internal combustion engine having an improved wear resistance. The sliding member has a sliding surface composed of a mixture of 50 to 97% by weight of high carbon ferrochromium and 3 to 50% by weight of ferrous alloy applied thereto by spraying. In a preferred embodiment, the ferrous alloy is high carbon iron containing at least 0.6% by weight of carbon.

1 Claim, 1 Drawing Figure

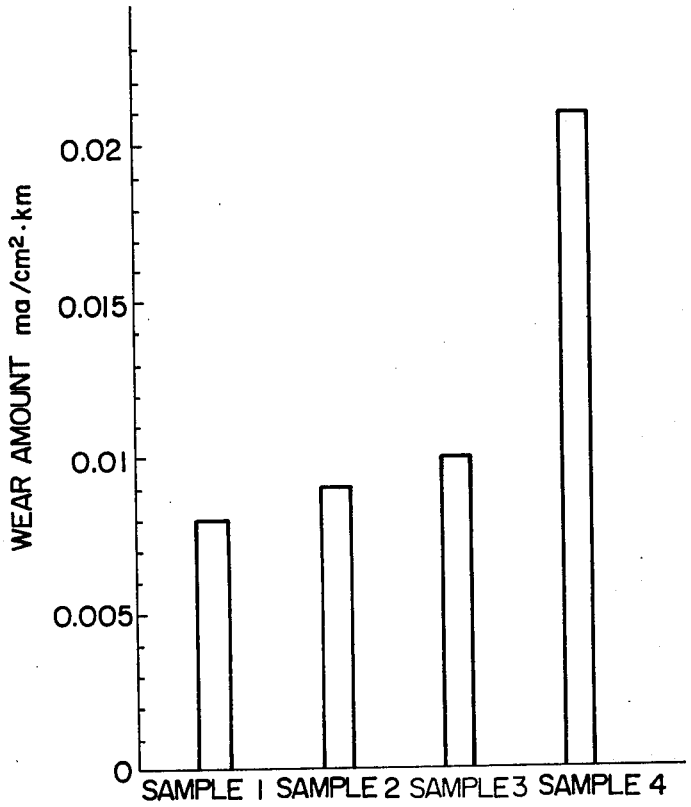
WEAR AMOUNT mg/cm²·km
0.02
0.015
0.01
0.005
0
SAMPLE 1
SAMPLE 2
SAMPLE 3
SAMPLE 4

SLIDING MEMBER FOR USE IN AN INTERNAL COMBUSTION ENGINE

BACKGROUND OF THE INVENTION

The present invention relates to a sliding member for which a high degree of wear resistance is required for use in an internal combustion engine.

The working conditions of an internal combustion engine have recently become increasingly severe due to the required high output and high speed of rotation, the effects of pollution control devices, and other factors. Accordingly, sliding parts in the engine need an improved wear resistance.

There are generally known two techniques for improving the wear resistance of such sliding parts. One of these is plating such as chromium plating or nickel composite plating. The other technique is the application by spraying of molybdenum or a mixture of various components. Both techniques, however, fail to satisfy the present requirements for a high degree of wear resistance.

SUMMARY OF THE INVENTION

In view of this, it is an object of the invention to provide a sliding member which can fully satisfy the present-day requirements for a high degree of wear resistance.

According to the invention, there is provided a sliding member for use in an internal combustion engine having a sliding surface containing a mixture of 50 to 97% by weight of high carbon ferrochromium and 3 to 50% by weight of ferrous alloy applied thereto by spraying.

BRIEF DESCRIPTION OF THE DRAWINGS

The single FIGURE is a graph showing the results of wear resistance tests conducted on examples of sliding members of the invention and the prior art.

DESCRIPTION OF THE PREFERRED EMBODIMENTS

A sliding member for use in an internal combustion engine according to the invention will now be described in further detail.

Although high carbon ferrochromium, which is used in this invention, exhibits a high degree of wear resistance due to its high hardness, a sprayed layer composed solely of high carbon ferrochromium is deficient in toughness, and the bonding strength of its particles is low. This results in microscopic peeling of high carbon ferrochromium particles during the operation of the sliding member. Particles which have peeled off cause abrasive wear on the sliding surface. This invention provides a successful solution to these problems by adding ferrous alloy.

Since ferrous alloys have a high bonding strength between particles thereof, the addition thereof to high carbon ferrochromium provides a strong support for the particles of high carbon ferrochromium, which by themselves have a low bonding strength, whereby microscopic peeling of high carbon ferrochromium particles is prevented. Accordingly, there is no abrasive wear on the sliding member of the invention.

During the use of the sliding member, the sliding surface thereof acquires a stepped portion due to the wear differential between the high carbon ferrochromium having a high hardness and the ferrous alloy which is relatively soft. The recess defined by this stepped portion is always filled with a lubricant. This greatly improves the scuffing and wear resistance of the sliding surface.

In order to realize the results as hereinabove described, it is necessary to employ proportions of high carbon ferrochromium and ferrous alloy within ranges which will hereinafter be set forth. Any proportion of high carbon ferrochromium that is less than 50% is unsuitable for a sliding member which must be highly resistant to wear for use in an internal combustion engine since there then results a deficiency of highcarbon ferrochromium, increasing the wear of high carbon ferrochromium per se.

If the sliding surface contains more than 97% of high carbon ferrochromium, the bonding strength of the particles is lowered resulting in microscopic peeling. This increases the abrasive wear of the sliding surface and increases the wear of the member with which the sliding surface is in sliding contact.

It is, therefore, necessary to employ high carbon ferrochromium within the range of 50 to 97% by weight.

Any amount of ferrous alloy that is less than 3% is insufficient to reinforce the bonding strength of high carbon ferrochromium particles. Microscopic peeling of high carbon ferrochromium particles results in abrasive wear of the sliding surface and an increase in wear of the member with which the sliding surface is in sliding contact.

Any sliding member containing more than 50% of ferrous alloy is also unsuitable as a sliding member which must be highly resistant to wear for use in an internal combustion engine since the wear resistance characteristics of the ferrous alloy per se then become prominent so that the overall wear resistance is decreased.

It is, therefore, necessary that the proportion of the ferrous alloy be within the range of 3 to 50% by weight.

It is very effective to use as the aforesaid ferrous alloy high carbon iron containing at least 0.6% by weight of carbon. The high carbon iron undergoes martensitic transformation and swells during the spraying operation. Accordingly, it is possible to reduce any strain that may develop during the spraying operation and prevent the peeling of high carbon ferrochromium particles more effectively.

As is believed evident from the foregoing description, this invention successfully overcomes the drawbacks of high carbon ferrochromium by adding thereto a specific amount of ferrous alloy thereby providing a sliding member having a higher degree of performance for use in an internal combustion engine than that which is obtained by incorporating only high carbon ferrochromium. Thus, this invention provides extremely advantageous results.

Wear resistance tests were conducted for verifying the superiority of the sliding member of the invention as will hereinafter be described.

Test samples were each prepared from a piece of ductile cast iron measuring 15 mm by 20 mm by 7 mm by applying a sprayed layer having a thickness of 0.2 mm onto the sliding surface thereof employing a plasma. The sprayed layer on a Sample 1 was composed of 95 wt% of high carbon ferrochromium and 5 wt% of high carbon iron composed of 0.8 wt% of C, 0.8 wt% of Si, and 0.7 wt% of Mn, the balance being Fe. The sprayed layer on a Sample 2 was composed of 90 wt% of high carbon ferrochromium and 10 wt% of high carbon iron containing 3 wt% of C, 0.8 wt% of Si and 0.7 wt% of Mn, the balance being Fe. The sprayed layer on a Sample 3 was composed of 55 wt% of high carbon ferrochromium and 45 wt% of ferrous alloy containing 0.02 wt% of C, 0.8 wt% of Si, 0.7 wt% of Mn and 13 wt% of Cr, the balance being Fe.

The high carbon ferrochromium particles on each sample had a hardness of HV 950. The high carbon iron particles on Sample 1 had a hardness of HV 500, those on Sample 2 had a hardness of HV 550, and the ferrous alloy particles on Sample 3 had a hardness of HV 550.

Sample 4 was prepared for comparison purposes. Sample 4 had a sliding surface on which a 0.2 mm thick layer composed solely of molydenum had been applied by spraying employing a plasma. Sample 4 had a hardness of HV 800.

Each of Samples 1 to 4 thus formed was mounted as a fixed sample in a rotary wear testing machine. The fixed sample was placed in contact under pressure with a disc-shaped sample formed from cast iron containing 3.2% of C, 2.0% of Si and 0.8% of Mn, the balance being Fe, and having a hardness of HRB 98. The disc-shaped sample was rotated while a lubricant was being supplied to the contacting surface of the samples. After tests were conducted under the following conditions, the amount of wear on each test sample was examined:

TEST CONDITIONS

Flow rate of the lubricant: 0.2 liter/min.
Lubricant: SAE #30
Load: 20 kg/cm$^2$
Sliding velocity: 5 m/sec.
Travel distance: 300 km.

The results, as shown in the FIGURE, clearly verify the superiority of the sliding member according to the invention as it showed only about a half of the wear as the prior art member having a sprayed layer composed solely of molydenum.

What is claimed is:

1. A sliding member for use in an internal combustion engine, said member having a sliding surface formed by flame-spraying a mixture of (a) 50 to 97% of high carbon ferrochromium and (b) 3 to 50% by weight of high-carbon iron containing at least 0.6% by weight carbon.

* * * * *